United States Patent [19]

Karashima

[11] 4,271,680

[45] Jun. 9, 1981

[54] REFRIGERATED SHOW CASE

[76] Inventor: Masashi Karashima, 88-5, Nakano, Ebina-shi, Kanagawa-ken, Japan

[21] Appl. No.: 64,629

[22] Filed: Aug. 7, 1979

[30] Foreign Application Priority Data

Jul. 3, 1979 [JP] Japan ..... 54-83442

[51] Int. Cl.[3] ..... A47F 3/04

[52] U.S. Cl. ..... 62/256

[58] Field of Search ..... 62/255, 256

[56] References Cited

U.S. PATENT DOCUMENTS

| | | | |
|---|---|---|---|
| 3,233,424 | 2/1966 | Vogel | 62/256 X |
| 3,243,971 | 4/1966 | Beckwith | 62/256 |
| 3,291,027 | 12/1966 | Beckwith | 62/256 X |
| 3,371,503 | 3/1968 | Perez | 62/256 |

*Primary Examiner*—Lloyd L. King

*Attorney, Agent, or Firm*—Wenderoth, Lind & Ponack

[57] ABSTRACT

A refrigerated show case has a cold air flow for refrigerating the interior of the show case circulated through a duct disposed along a bottom wall, rear wall and top wall of the show case and across a front opening thereof. Frosting and flow-regulating devices including a plurality of net-like plates is disposed upstream of an evaporator within the duct so that air sucked into the duct is forced to frost on the frosting and flow-regulating devices when it passes through the frosting and flow-regulating means.

2 Claims, 4 Drawing Figures

REFRIGERATED SHOW CASE

BACKGROUND OF THE INVENTION

The present invention relates in general to a refrigerated show case, and more particularly to improvements in a refrigerated show case of the type whether a cold air flow for refrigerating the interior of the show case is circulated through a duct disposed along a bottom wall, rear wall and top wall of the show case and across a front opening thereof.

The above-mentioned type of refrigerated show case has been heretofore known, in which air sucked into the duct through a suction port along a lower edge of the front opening of the show case is refrigerated by an evaporator disposed within the duct, passed through the duct disposed along the bottom wall, rear wall and top wall of the show case, ejected from an ejection port along an upper edge of the front opening, and sucked through the suction port along the lower edge of the front opening, and in this way the refrigerated air circulates around the interior of the show case while forming an air curtain across the front opening, and refrigerates goods displayed within the show case during the circulation. However, in the above type of refrigerated show case in the prior art, frosting on the evaporator within the duct was remarkable, and hence there was a shortcoming that the refrigerating efficiency was greatly degraded.

SUMMARY OF THE INVENTION

Therefore, it is one object of the present invention to provide an improved refrigerated show case in which frosting on an evaporator disposed within a duct for circulating a cold air flow for refrigerating the interior of the show case can be prohibited by simple means and thereby a good refrigerating efficiency can be achieved.

According to one feature of the present invention, there is provided a refrigerated show case in which a cold air flow for refrigerating the interior of the show case is circulated through a duct disposed along a bottom wall, rear wall and top wall of the show case and across a front opening thereof, and in which frosting and flow-regulating devices including a plurality of net-like plates is disposed upstream of an evaporator within the duct so that air sucked into the duct may be forced to frost on the frosting and flow-regulating devices when it passes through the frosting and flow-regulating devices.

According to the present invention, since frosting and flow-regulating devices including a plurality of net-like plates are disposed upstream of an evaporator within a duct as described above, the flow of air sucked into the duct is regulated by the frosting and flow-regulating devices so as to be supplied at a uniform flow rate over the entire surface of the evaporator and to be refrigerated uniformly. Hence, locally deviated frosting on the evaporator will not occur, but moisture contained in the air will adhere as a frost on the network of the net-like plates forming the frosting and flow-regulating devices. In this way, the moisture contained in the air sucked into the duct is forced to frost on the network of the net-like plates forming the frosting and flow-regulating devices. As a result the air sucked into the duct is greatly dehumidified, and accordingly frosting on the evaporator when the air passes through the evaporator within the duct is extremely reduced. Consequently the refrigerating function of the evaporator can be fully achieved, and therefore, the refrigerating efficiency of the refrigerated show case can be greatly enhanced.

According to another feature of the present invention, there is provided an above-featured refrigerated show case in which the frosting and flow-regulating devices consist of a first frosting and flow-regulating member including a plurality of vertical net-like plates arrayed at a predetermined interval in the widthwise direction of the show case, and a second frosting and flow-regulating member including a net-like plate with a plurality of openings formed therein and disposed downstream of and at right angles to the first frosting and flow-regulating member so as to extend in the widthwise direction of the show case.

Since the refrigerated show case according to the present invention has the above-mentioned structural features, when the air sucked into the duct passes through the first and second frosting and flow-regulating members, moisture contained in the air is forced to frost on the respective frosting and flow-regulating members, resulting in dehumidifying of the air and reduction of frosting on the evaporator. Moreover, when the air sucked into the duct passes through the plurality of vertical net-like plates arrayed at a predetermined interval in the widthwise direction of the show case in the first frosting and flow-regulating member, it is regulated in flow so as to have a uniform flow rate along the widthwise direction of the show case, and thereafter when the air passes through the net-like plate with a plurality of openings formed therein and extending in the widthwise direction of the show case, it is regulated in flow so as to have a uniform flow rate along the vertical direction. As a result, the air sucked into the duct is supplied at a uniform flow rate over the entire surface of the refrigerator so as not to cause any local deviation of the air flow supplied to the evaporator, whereby locally concentrated adhesion of frost can be prohibited and a performance of the evaporator can be improved.

BRIEF DESCRIPTION OF THE DRAWINGS

Other features and advantages of the invention will become more apparent upon a perusal of the following specification taken in connection with the accompanying drawings, wherein.

DETAILED DESCRIPTION OF THE INVENTION

Figure 1:
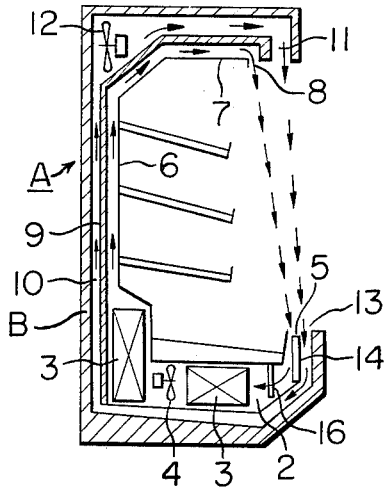
FIG. 1 is a schematic longitudinal cross-sectional view of one preferred embodiment of the refrigerated show case according to the present invention.
Figure 3:
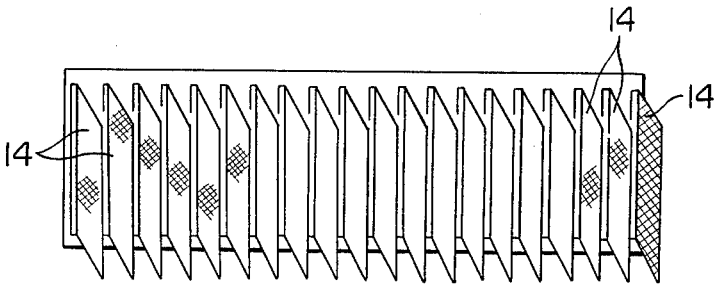
FIG. 3 is a perspective view of a first frosting and flow-regulating member to be used according to the present invention.
Figure 4:
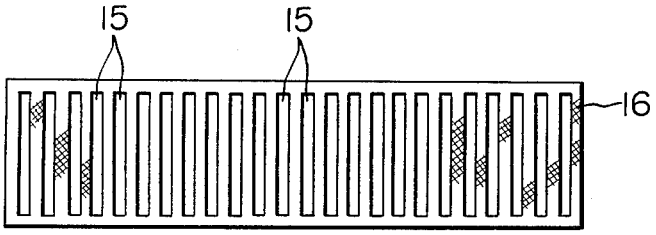
FIG. 4 is a front view of a second frosting and flow-regulating member to be used according to the present invention.
Figure 2:
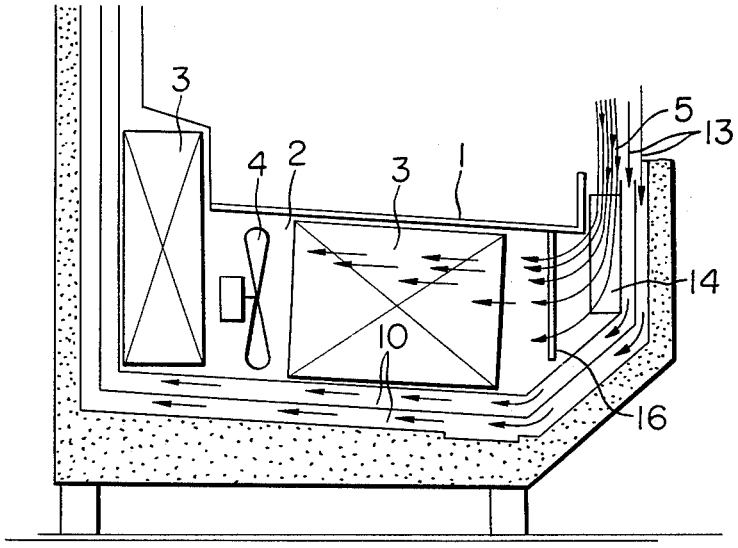
FIG. 2 is an enlarged schematic longitudinal cross-sectional view of an essential portion of the refrigerated show case in FIG. 1.

Referring now to of the drawings, a refrigerated show case according to the present invention is generally designated by reference A, in which an evaporator 3 and a fan 4 are contained in a duct 2 of a cold air flow for refrigerating goods displayed within the show case. A front end of the duct is communicated with a suction port 5 along a lower edge of a front opening of the show case, while a rear end of the duct 2 extends vertically upwards along a rear wall 6 of the show case, further extends horizontally along a top wall 7 of the show case, and is finally communicated with an ejection port 8 along an upper edge of the front opening of the show case. In the figures, reference numeral 9 designates a heat insulation partition wall disposed within the show case.

Reference B designates a panel enclosing the outside of the above-described show case A, and between the panel B and an outer wall 9 of the duct 2 including the aforementioned partition wall is formed another duct 10 which extends in parallel flow to the duct 2, and this duct 10 is communicated with another ejection port 11 disposed along the upper edge of the front opening of the show case outside of and adjacent to the above-described ejection port 8. In the figures, reference numeral 12 designates a fan for circulating cold air through the duct 10.

Accordingly, cold air for refrigerating the interior of the show case which has been sucked into the duct 2 by means of the fan 4 passes through the respective sections of the duct 2 in the bottom wall 1, rear wall 6 and top wall 7 and is ejected from the ejection port 8 along the upper edge of the front opening, then it is sucked into the duct 2 through the suction port 5 along the lower edge of the front opening, and thus refrigerates the goods displayed within the show case while it is circulated along the bottom wall, rear wall 6 and top wall 7.

On the other hand, air sucked into the duct 10 through another suction port 13 along the lower edge of the front opening by means of the other fan 12 is refrigerated by the evaporator 3 and the cold air within the duct 2 while it passes through the respective sections of the duct 10 in the bottom wall 1, rear wall 6 and top wall 7, then it is ejected from the ejection port 11 along the upper edge of the front opening of the show case and sucked through the suction port 13 along the lower edge of the front opening, and thereby an additional air curtain of low temperature air is formed outside of the air curtain of the cold air for refrigerating the interior of the show case across the front opening of the show case, so that the cold air may not come into contact with the high-temperature high-humidity ambient air and may not result in a temperature rise.

However, without any further provision, during the aforementioned operation, moisture contained in the air sucked into the duct 2 would frost on the evaporator 3, and moreover, the flow rate of the air flow sucked into the duct 2 is not uniform over the entire cross-sectional area of the duct 2, so that locally deviated frosting would occur on the evaporator 3 and thereby a performance of the evaporator 3 is degraded.

Whereas, according to the present invention, the first frosting and flow-regulating member consisting of a plurality of vertical net-like plates 14 is disposed immediately beneath the suction port 5 of the duct 2 within the duct 2 with the vertical net-like plates 14 arrayed at a predetermined interval along the widthwise direction of the show case.

Furthermore, downstream of the first frosting and flow-regulating member within the duct 2 is disposed a second frosting and flow-regulating member consisting of a net-like plate 16 with a plurality of openings 15 formed uniformly over its entire surface area and extending horizontally in the widthwise direction of the show case and at right angles to the surfaces of the net-like plates 14 of the first frosting and flow-regulating member. Therefore, the flow of the air sucked through the suction port 5 into the duct 2 is at first regulated by the net-like plates 14 of the first frosting and flow-regulating member arrayed at a predetermined interval along the widthwise direction of the show case when the flow of air passes through the net-like plates 14, so that the flow rate is equalized along the widthwise direction of the show case and the moisture contained in the air adheres as frost on the network of the net-like plates 14 forming the first frosting and flow-regulating member, whereby the absolute humidity of the sucked-in air can be lowered.

Subsequently, the flow of sucked-in air which has been dehumidified and the flow of which has been once regulated by the net-like plates 14 of the first frosting and flow-regulating member, is again regulated so as to have its flow rate equalized along the vertical direction by the net-like plate 16 of the second frosting and flow-regulating member disposed at right angles to the net-like plates 14 of the first frosting and flow-regulating member when it passes through the plurality of openings formed in the net-like plate 16, and the moisture contained in the sucked-in air adheres as frost on the network of the net-like plate 16 forming the second frosting and flow-regulating member, whereby the absolute humidity of the sucked air can be further lowered.

As described above, according to the present invention, a air which has been fully dehumidified and which has its flow rate equalized over the entire cross-sectional area of the duct 2 by the net-like plates 14 and 16 of the first and second frosting and flow-regulating members, is refrigerated by the evaporator 3 and circulated through the duct 2 along the bottom wall 1, rear wall 6 and top wall 7 of the show case. During this operation, frosting onto the evaporator 3 is extremely reduced because the air has been preliminarily dehumidified as described above, and also since the flow rate of the air is equalized over the entire cross-sectional area of the duct 2 in the above-described manner, frost would not adhere in a deviated manner onto the evaporator. As a result, a refrigerating capability of the evaporator 3 can be fully achieved and the refrigerating efficiency can be greatly enhanced.

Since many changes could be made in the above construction and many apparently widely different embodiments of this invention could be made without departing the scope thereof, it is intended that all matter contained in the above description or shown in the accompanying drawings shall be interpreted as illustrative and not as limiting.

I claim:

1. In a refrigerated show case of the type wherein a cold air flow for refrigerating the interior of the show case is circulated through a duct disposed along a bottom wall, a rear wall and a top wall of the show case and across a front opening thereof, and wherein said duct has therein an evaporator for cooling the show case, the improvement comprising:

first and second frosting and flow-regulating means, disposed in said duct upstream of said evaporator, for substantially dehumidifying said cold air flow and causing moisture in said cold air flow to frost on said first and second frosting and flow-regulating means, while substantially preventing frosting on said evaporator, and for equalizing the flow rate of said cold air flow throughout the entire transverse cross-sectional area of said duct, such that any moisture remaining in said cold air flow after the substantial dehumidification thereof by said first and second frosting and flow-regulating means will not be concentrated at any area of said evaporator, thereby preventing localized frosting on said evaporator;

said first frosting and flow-regulating means comprising a plurality of net-like plates positioned in said duct to extend vertically, said plates being spaced at pedetermined intervals in the widthwise direction of said show case; and said second frosting and flow-regulating means comprising a net-like plate positioned in said duct at a location downstream of said plurality of net-like plates, said net-like plate having therein a plurality of openings, said net-like plate extending in said widthwise direction of said show case and at right angles to said plurality of net-like plates.

2. The improvement claimed in claim 1, wherein said openings in said net-like plate are elongated vertically.

* * * * *